United States Patent [19]
McBride

[11] 4,127,953
[45] Dec. 5, 1978

[54] ANTI-RECOIL BOOT

[76] Inventor: Willis M. McBride, Elsie Rt., Box 430, Seaside, Oreg. 97138

[21] Appl. No.: 823,593

[22] Filed: Aug. 11, 1977

[51] Int. Cl.² ..... F41C 27/00
[52] U.S. Cl. ..... 42/1 W; 42/71 R
[58] Field of Search ..... 42/74, 71 R, 1 W

[56] References Cited

U.S. PATENT DOCUMENTS

| | | | |
|---|---|---|---|
| 404,921 | 6/1889 | Miller | 42/1 W |
| 1,973,811 | 9/1934 | Jessup | 42/74 |
| 2,188,691 | 1/1940 | Rigandi | 42/74 |
| 2,282,428 | 5/1942 | Rigandi | 42/74 |
| 2,451,473 | 10/1948 | Cooper | 42/74 |
| 2,605,033 | 7/1952 | Terry | 42/71 R |
| 3,619,925 | 11/1971 | Martin et al. | 42/1 W |

OTHER PUBLICATIONS

"The American Rifleman" vol. 124, No. 11, p. 43; Nov. 1976.

*Primary Examiner*—Charles T. Jordan
*Attorney, Agent, or Firm*—Francis Swanson

[57] ABSTRACT

An anti-recoil boot for large caliber rifles is disclosed. The boot mounts detachably on the stock of a rifle. The construction defines two large pockets into which may be inserted large quantities of lead shot or other heavy ballast. The total weight of the rifle is thus significantly increased. This results in a substantial reduction in recoil when the rifle is fired.

9 Claims, 5 Drawing Figures

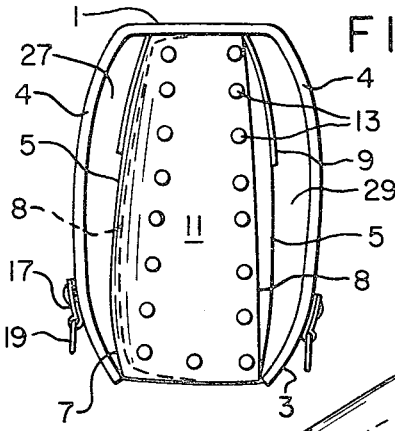
FIG. 3
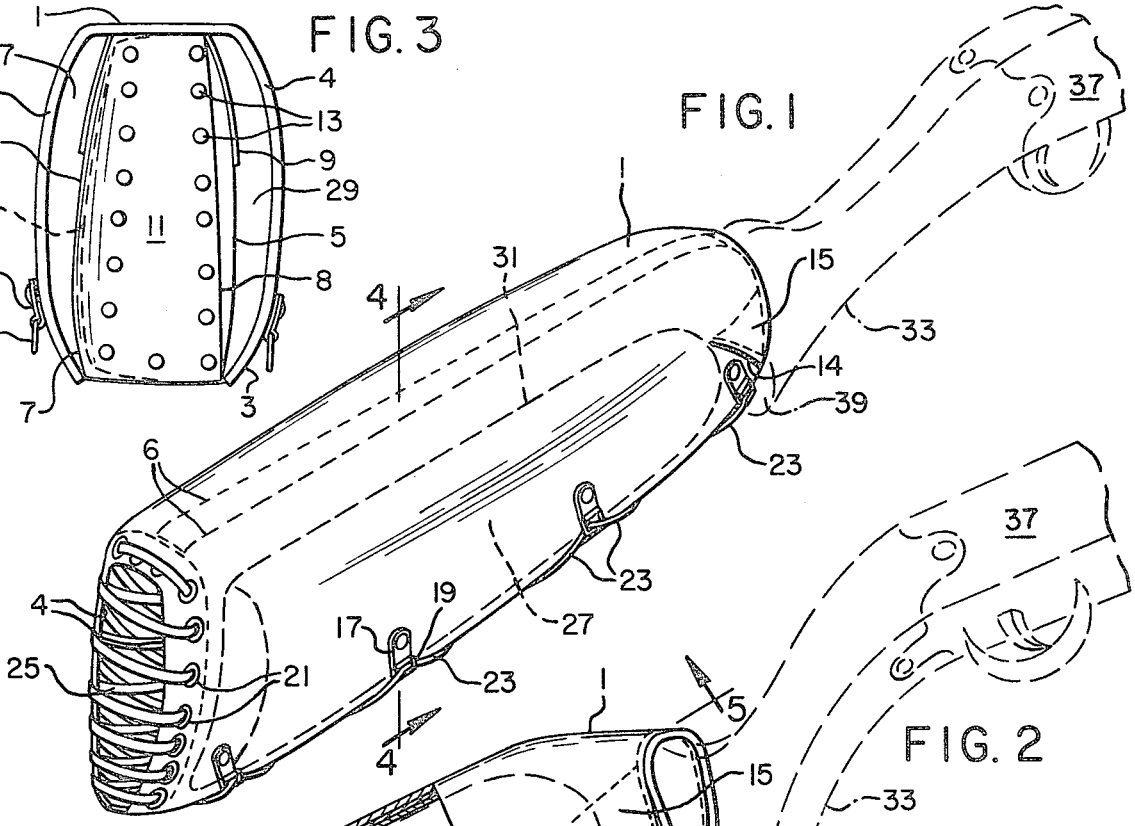
FIG. 1
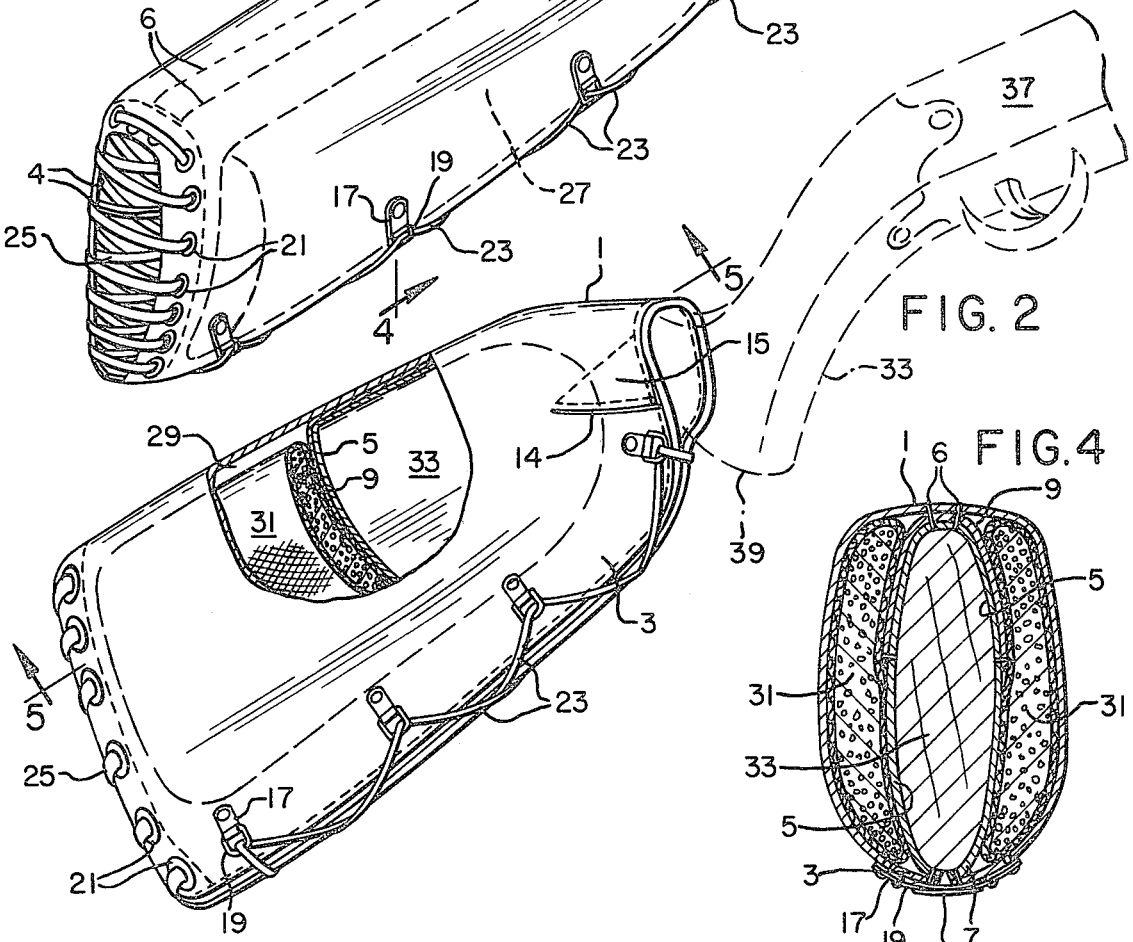
FIG. 2
FIG. 4
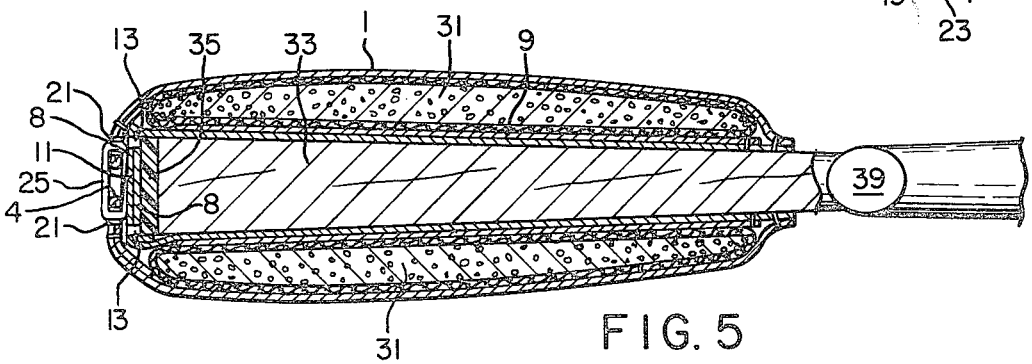
FIG. 5

ANTI-RECOIL BOOT

BACKGROUND OF THE INVENTION

1. Field of the Invention

This invention pertains to anti-recoil devices in general and more particularly to boot types capable of carrying a variable amount of weight.

2. Description of the Prior Art

The most common approach to reducing recoil in a large caliber rifle is to equip it with rubber pads mounted on the butt of the stock. Another approach mounts a hydraulic shock absorber in the stock. For fixed targets shooters often place large bags of sand between the stock and their shoulders so as to absorb recoil. Still other place the rifle in a mechanical shooting rest. This method is illustrated in U.S. Pat No. 2,582,140. The foregoing methods are either expensive, or are cumbersome and ineffective.

SUMMARY OF THE INVENTION

It is a principal object of the invention to provide a simple, easily detachable compact recoil reducing device.

It is a further object to provide a recoil reducing device which when mounted is capable of providing a variable amount of weight addition to the rifle.

A still further object is to provide a recoil reducing device in the form of a boot mounting over the rifle stock.

Another object is to provide a device which may alternately be used to carry other objects when mounted on the rifle.

Other objects and advantages will be apparent to those skilled in the art, having reference to the accompanying drawings and specification.

BRIEF DESCRIPTION OF THE DRAWINGS

FIG. 1 is a perspective view of the invention as mounted on a rifle stock.

FIG. 2 is a perspective view of the invention as mounted on a rifle stock and partly broken away to show details of the internal construction.

FIG. 3 is an elevational view of the device mounted on the rifle as viewed from the butt of the rifle stock.

FIG. 4 is a sectional view taken along lines 4—4 of FIG. 1.

FIG. 5 is a sectional view taken along lines 5—5 of FIG. 2.

DETAILED DESCRIPTION

Referring now to the drawings, FIG. 1 shows the boot mounted on a rifle. The drawing is broken away to reveal the relation of the various components. The anti-recoil boot comprises an outer shell 1, preferably of leather, which has lower lips 3 and rear edges 4. Joined to and surrounded by outer shell 1 is an inner shell 5, having a lower lip 7. Outer shell 1 and inner shell 5 are centrally joined by stitching 6 which also joins lower lips 3 and 7. An inner reinforcing member 9 is interposed centrally between outer shell 1 and inner shell 5 and is held by stitching 6. Two rear flaps 8 on inner shell 5 are overlapped to form a thickened butt 11. Rivets 13 anchor the rear flaps 8 to one another.

Outer shell 1 is slit on both sides at 14 and overlapped to form thickened front reinforcement 15. Along lower lip 3 of outer shell 1 are mounted fasteners 17 having swiveling loops 19. The rear edges 4 of outer shell 1 have mounted thereon a series of round eyelets 21, through which is threaded lace 25. A second lace 23 is threaded through loops 19 of fastener 17. With this construction outer shell 1 and inner shell 5 define left pocket 27 and right pocket 29, each of which receives a lead shot bag 31.

OPERATION

When it is desired to use the anti-recoil boot laces 23 and 25 are loosened. The boot is then slipped onto stock 33 of rifle 37 until butt 11 of the boot rests against rifle butt plate 35 and front reinforcement members 15 are adjacent pistol grip 39 of stock 33. Shot bages 31, which may weigh 12 pounds each, are inserted into pockets 27 and 29. It is of course obvious that the weight of the shot bags may be varied to suit the needs of the user. Laces 23 and 25 are than cinched up tight. Lace 25, being threaded through eyelets 21, draw rear edges 4 of outer shell 1 together closing pockets 27 and 29 around shot bags 31 securing the bags tightly. Lace 23, when cinched, draws lower lips 3 and 7 together tightly around the lower edge of stock 33. The boot and rifle are now ready for use.

It is well known from the laws of physics that, expressed mathematically, when a rifle is fired the product of the mass of the bullet and its velocity is equal to the mass of the rifle times the velocity of its recoil. Thus, $m_1v_1 = m_2v_2$ where $m_1$ and $v_1$ are the mass and velocity of the bullet respectively and $m_2v_2$ are respectively the mass and recoil velocity of the rifle. From this relation it is easily seen that increasing the total weight of a rifle from approximately 6 to 30 pounds by the addition of an additional 24 pounds of lead shot will substantiallly decrease the recoil of the rifle when fired. As noted above, the amount of lead shot in bags 31 may be varied to suit the desires of the user. It is also apparent that the boot may be used entirely without shot bags 31 as in sport hunting. The pockets 27 and 29 may then be used to carry maps, matches or other items.

Having illustrated and described the preferred embodiment of my invention in detail, it will be apparent to those skilled in the art that many modifications could be made thereto without departing from the true spirit and scope of the invention. I claim all such modifications as fall within the scope and equivalence of the appended claims.

I claim:

1. An anti-recoil boot for a firearm comprising:
   - a first outer shell;
   - a second inner shell connected to the outer shell to form a pocket;
   - and a metal recoil reducing weight of relatively substantial mass within the pocket.

2. The apparatus of claim 1 wherein the weight comprises a bag filled with metal.

3. The apparatus of claim 2 wherein the bag of metal is removable from the pocket.

4. The apparatus of claim 2 wherein the metal in the bag comprises particulate matter in the form of shot.

5. An anti-recoil boot for a firearm having a stock comprising:
   - a first outer shell;
   - a second inner shell joined to the outer shell to define a pocket;
   - means on the outer shell to close the pocket;
   - a metal filled bag of relatively substantial mass within the pocket;

and means for securing the boot to the stock of the firearm.

6. The apparatus of claim 5 wherein the pocket closing means includes lace engaging means on the outer shell and a lace operatively connected to said engaging means.

7. Apparatus according to claim 5 wherein the boot securing means includes a plurality of lips defined by the outer and inner shells and means for drawing the lips substantially together in surrounding relation to the stock.

8. Apparatus according to claim 7 wherein the lip drawing means includes at least one fastener mounted on the outer shell and a fastener engaging lace.

9. An anti-recoil boot for a firearm having a stock comprising:

a first and a second shell joined together to define a plurality of stock surrounding lips, the shells further defining a weight receiving pocket;

a container filled with metallic particles of relatively substantial mass within the pocket;

pocket closing means on the first shell;

and means on the shells for drawing the lips together on the stock.

* * * * *